US005547597A

United States Patent [19]

Koganei et al.

[11] Patent Number: 5,547,597

[45] Date of Patent: Aug. 20, 1996

[54] LUBRICATING OIL COMPOSITION FOR TWO-CYCLE ENGINES

[75] Inventors: Katsuya Koganei; Takeshi Nomura; Toshiaki Kuribayashi; Noboru Umemoto, all of Ohi-machi, Japan

[73] Assignee: Tonen Corporation, Tokyo, Japan

[21] Appl. No.: 444,094

[22] Filed: May 18, 1995

Related U.S. Application Data

[63] Continuation of Ser. No. 67,807, May 27, 1993, abandoned.

[30] Foreign Application Priority Data

May 29, 1992 [JP] Japan ..... 4-139405

[51] Int. Cl.[6] ..... C10M 105/42; C10M 129/78

[52] U.S. Cl. ..... 508/409; 508/474; 508/485

[58] Field of Search ..... 252/56 R, 56 S

[56] References Cited

U.S. PATENT DOCUMENTS

| | | | |
|---|---|---|---|
| 2,991,252 | 7/1961 | Pethrick et al. | 252/47.5 |
| 3,505,230 | 4/1970 | Thompson | 252/57 |
| 3,838,049 | 9/1974 | Souillard | 252/32.7 E |
| 3,859,218 | 1/1975 | Jervis et al. | 252/32.5 |
| 4,759,860 | 7/1988 | Tanaka et al. | 252/56 R |
| 4,994,196 | 2/1991 | Kagaya et al. | 252/56 R |
| 5,064,546 | 11/1991 | Dasai | 252/45 |

FOREIGN PATENT DOCUMENTS

| | | |
|---|---|---|
| 0024146 | 2/1981 | European Pat. Off. . |
| 0365081 | 4/1989 | European Pat. Off. . |
| 0535990 | 4/1993 | European Pat. Off. . |
| 828956 | 2/1960 | United Kingdom . |
| 1131926 | 10/1968 | United Kingdom . |

OTHER PUBLICATIONS

Smalheer et al., Chemistry of Additives, Lubricant Additives, pp. 1–11 (1967) no month.

*Primary Examiner*—John Niebling
*Assistant Examiner*—Edna Wong
*Attorney, Agent, or Firm*—Armstrong, Westerman, Hattori, McLeland & Naughton

[57] ABSTRACT

A lubricating oil composition for two-cycle engines, consisting essentially of, by weight: (1) 30% to 70% of a polyol ester having a kinematic viscosity of 9 to 15 cSt at 100° C., 30% to 70% of a diester having a kinematic viscosity of 2 to 5 cSt at 100° C., 1% to 5% of a polybutene having a molecular weight of 500 to 2,500 and/or 1% to 5% of a polymethacrylate having a molecular weight of 5,000 to 40,000, and 5% to 25% of a dispersant; or (2) 30% to 70% of a polyol ester having a kinematic viscosity of 4 to 15 cSt at 100° C., 0% to 35% of a complex ester having a kinematic viscosity of 10 to 14 cSt at 100° C., 10% to 70% of a diester having a kinematic viscosity of 2 to 5 cSt at 100° C., and. 5% to 25% of a dispersant; or (3) a lubricating oil base, 5% to 25% of a polyamide dispersant, and 0.1% to 5% of a combination of a neutral calcium sulfonate and a neutral calcium salicylate, based on the total weight of the composition. Composition (1) is excellent in biodegradability, miscibility with gasoline, anti-seizure performance and detergency. Composition (2) is excellent in biodegradability. Composition (3) has excellent high-temperature detergency and low viscosity at low temperature and can be also made excellent in biodegradability, miscibility with gasoline and anti-seizure performance when the oil base in composition (1) is used as a lubricating oil base.

3 Claims, No Drawings

LUBRICATING OIL COMPOSITION FOR TWO-CYCLE ENGINES

This application is a continuation of application Ser. No. 08/067,807 filed May 27, 1993, now abandoned.

BACKGROUND OF THE INVENTION

The present invention relates to a lubricating oil composition for two-cycle engines, which is excellent in biodegradability, miscibility with gasoline, anti-seizure performance, and detergency at high temperature, and can be reduced in viscosity at low temperature as well.

Engine oil—in which an inexpensive mineral oil type of lubricating oil is used as the base oil and which may optionally contain cleaners and anti-wear agents—has been widely used. Lubricating oil used with two-cycle engines for motorcycles, outboard motors, etc., on the other hand, is now increasingly required to have miscibility with gasoline and anti-seizure performance, especially biodegradability. Unburned lubricating oil discharged from two-cycle engines are now known to pollute sea, and lakes and marshes, posing grave environmental problems. In other words, there is a strong demand for lubricating oil that has a high engine oil function well-enough to ensure that the required properties are achievable in small quantities, and is biodegradable as well, so that, when discharged into water, it can be easily degraded by water microorganisms.

In view of such situations, there has recently been developed a biodegradable type of lubricating oil which is mainly made up of a well-biodegradable polyol ester and in which an oil diluent such as kerosene or hydrogenated mineral oil is incorporated so as to assure miscibility with gasoline (see JP-A-4-120195). However, oil products containing a hydrocarbon type base oil as the oil diluent are still less than satisfactory in terms of biodegradability, due to its low biodegradability.

A so-called separate lubrication mode—in which fuel is mixed with lubricating oil in a two-cycle engine—has also been proposed. However, problems associated with this mode are that the lubricating oil becomes poor in fluidity at low temperature, so that it cannot be well miscible with gasoline, and it becomes poor in detergency at high temperature, making the amount of deposits larger.

The first object of the invention is to provide a lubricating oil composition for two-cycle engines, which can be used as engine oil that is excellent not only in biodegradability but also in miscibility with gasoline, anti-seizure performance and detergency.

The second object of the invention is to provide a lubricating oil composition for two-cycle engines, which can be used as engine oil that is particularly excellent in biodegradability.

The third object of the invention is to provide a lubricating oil composition for two-cycle engines, which has application in a wide range of temperatures; that is, which is excellent in detergency at high temperature, can be reduced in terms of viscosity at low temperature, and is improved in terms of miscibility with gasoline.

SUMMARY OF THE INVENTION

According to one aspect of the invention, there is provided a lubricating oil composition for two-cycle engines, which comprises;

(a) 30% by weight to 70% by weight of a polyol ester having a kinematic viscosity of 9 to 15 cSt at 100° C., (b) 30% by weight to 70% by weight of a diester having a kinematic viscosity of 2 to 5 cSt at 100° C., (c) 1% by weight to 5% by weight of a polybutene having a molecular weight of 500 to 2,500 and/or 1% by weight to 5% by weight of a polymethacrylate having a molecular weight of 5,000 to 40,000, and (d) 5% by weight to 25% by weight of a dispersant. The first composition of the invention is obtained by incorporating the diester in the polyol ester so as to achieve miscibility with gasoline, with the addition to it of the polybutene and/or the polymethacrylate for the achievement of anti-seizure performance and the ashless dispersant for the achievement of detergency. Since both the polyol ester and diester are excellent in biodegradability, this composition lends itself well-fit for a lubricating oil composition for two-cycle engines that are used with outboard motors, chain-saw motors, etc., and so must be improved in terms of the properties needed, such as biodegradability, anti-seizure performance, miscibility with gasoline, and detergency.

According to another aspect of the invention, there is provided a lubricating oil composition for two-cycle engines, which comprises:

(a) 30% by weight to 70% by weight of a polyol ester having a kinematic viscosity of 4 to 15 cSt at 100° C., (b) 0% by weight to 35% by weight of a complex ester having a kinematic viscosity of 10 to 14 cSt at 100° C., (c) 10% by weight to 70% by weight of a diester having a kinematic viscosity of 2 to 5 cSt at 100° C., and (d) 5% by weight to 25% by weight of a dispersant.

The second composition of the invention is prepared by incorporating the diester in the polyol ester so as to achieve miscibility with gasoline, with the addition of the complex ester that serves as a viscosity-regulating heavy oil and the dispersant with a view to achieving detergency. Since the polyester, diester and complex ester are all excellent in biodegradability, this composition can provide a well-biodegradable lubricating oil composition for two-cycle engines.

According to a further aspect of the invention, there is provided a lubricating oil composition for two-cycle engines, which is obtained by the incorporation in a lubricating base oil of 5% by weight to 25% by weight of a polyamide type dispersant and a neutral calcium sulfonate and a neutral calcium salicylate which amount to 0.1% by weight to 5% by weight in all.

The third composition of the invention, because the lubricating base oil contains the polyamide type dispersant as a dispersant and further includes the neutral calcium sulfonate and calcium salicylate, can have application in a wide range of temperatures; that is, it can achieve detergency at high temperature, can be reduced in terms of viscosity at low temperature, and can be made excellent in miscibility with gasoline. Thus, this composition is well fit for a lubricating oil composition for two-cycle engines that are used with outboard motors, chain-saw motors, etc., and is particularly best suited for use on the so-called separate lubrication mode in which, as already mentioned, fuel is mixed with lubricating oil in a two-cycle engine.

DESCRIPTION OF THE PREFERRED EMBODIMENT

The components of the first composition according to the invention will now be explained at great length.

The polyol ester is a polyester of an aliphatic polyhydric alcohol with a linear or branched fatty acid. The aliphatic polyhydric alcohol forming the polyester, by way of example but not by way of limitation, neopentyl glycol, trimethylolpropane, ditrimethylolpropane, trimethylolethane, ditrimethylolethane, pentaerythritol, dipentaerythritol, and tripentaerythritol, and the fatty acid used, by way of example but not by way of limitation, is one having 16 to 24 carbon atoms. Preferably but not exclusively, heptadecylic acid, stearic acid, nonadecanoic acid, arachic acid, behenic acid and lignoceric acid are usable to this end.

Also, partial esters of the aliphatic polyhydric alcohol with the linear or branched fatty acid may be used. These partial esters may be obtained by the reaction of the aliphatic polyhydric alcohol with the fatty acid while their number of reaction moles is controlled.

The polyol ester used has a kinetic viscosity of 9 to 15 cSt, preferably 11 to 14 cSt, as measured at 100° C., and is excellent in biodegradability, and is used as the base for lubricating oil. It is noted that this polyol ester becomes poor in anti-seizure performance at less than 9 cSt and poses a problem in connection with biodegradability at higher than 15 cSt.

The polyol ester may account for 30% by weight to 70% by weight, preferably 40% by weight to 60% by weight of the composition. At less than 30% by weight the composition tends to reduce in terms of anti-seizure performance, and at higher than 70% by weight the composition reduces in terms of miscibility with gasoline.

Next, detailed explanation will be given to the diester used in the invention.

The carboxylic acid component of the diester may be a linear or branched aliphatic dibasic acid having 6 to 10 carbon atoms. By way of example but not by way of limitation, adipic acid, pimelic acid, suberic acid, azelaic acid, sebacic acid and other acids having like properties are mentioned. The alcoholic component may be an aliphatic alcohol having 6 to 10 carbon atoms. Illustratively but not exclusively, hexyl alcohol, heptyl alcohol, octyl alcohol, nonyl alcohol and decyl alcohol as well as their isomers are mentioned.

The diester has a kinematic viscosity of 2 to 5 cSt, preferably 2 to 4 cSt, as measured at 100° C., and is used so as to achieve an improvement in miscibility with gasoline. At higher than 5 cSt the miscibility becomes poor.

The diester may account for 30% by weight to 70% by weight, preferably 40% by weight to 50% by weight of the composition. At less than 30% by weight the composition becomes poor in miscibility with gasoline, and at higher than 70% by weight the composition offers a problem in connection with anti-seizure performance.

The polybutene is added to the composition as a heavy base oil so as to impart an anti-seizure performance thereto, and so should have a molecular weight of 500 to 2,500, preferably 500 to 1,500, more preferably 700 to 1,000. The composition, when containing a polybutene with the molecular weight exceeding 2,500, becomes poor in detergency.

The polybutene may account for 1% by weight to 5% by weight, preferably 1.5% by weight to 3.5% by weight of the composition. The composition, when containing more than 5% by weight of the polybutene, poses a problem in that its anti-seizure performance drops, because the amount of the diester used must be increased so as to regulate the viscosity of the composition.

The polymethacrylate may be used in place of the polybutene. The polymethacrylate has then a molecular weight of 5,000 to 40,000, preferably 10,000 to 20,000, and is added to the composition as a heavy base oil so as to impart an anti-seizure performance thereto. The composition, when containing a polymethacrylate with the molecular weight exceeding 40,000, becomes poor in detergency.

The polymethacrylate used may be of either a dispersion type or a non-dispersion type, and has the following structures:

DISPERSION-TYPE POLYMETHACRYLATE

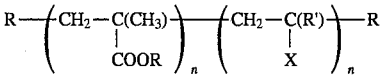

NON-DISPERSION-TYPE POLYMETHACRYLATE

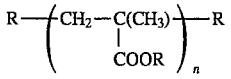

Here, R stands for a hydrocarbon group having 1 to 18 carbon atoms, R' a hydrogen atom or a methyl group, X a polar group, and n an integer of 10 to 1,000.

The polymethacrylate may account for 1% by weight to 5% by weight, preferably 2% by weight to 5% by weight of the composition. The composition, when containing more than 5% by weight of the polymethacrylate, offers a problem in that its detergency drops. In this connection, it is noted that the polymethacrylate may be used in combination with the polybutene.

The dispersant is added to the composition for the purpose of achieving detergency, and is preferably of the ashless type. Preferably, polyamides, amide succinates (that may be denatured by boron) and benzylamines (that may be denatured by boron) are used, but the most preference is given to polyamides. Examples of the polyamide dispersants, which are prepared by the reaction of polyamines with fatty acids are Lubrizol 390, Lubrizol 397 and Lubrizol 398, all made by Lubrizol Co., Ltd., as well as Oronite 340R and Oronite RB made by Oronite Japan Co., Ltd. These are added to the composition so as to prevent formation of deposits and varnish on piston/cylinder sites, and used in an amount of 5% by weight to 25% by weight, preferably 10% by weight to 20% by weight.

Additionally and if required, the composition of the invention may contain rust inhibitors, anti-foamants, metal detergents, anti-wear agents, antioxidants, pour point dispersants, and so on.

The first composition of the invention may be used in the form of a low-oil mixture, e.g., a 100-to-1 gasoline mixture.

In the following description, the components of the second composition according to the invention will be explained at great length.

The polyol ester of the second composition is a polyester of an aliphatic polyhydric alcohol with a linear or branched fatty acid.

The aliphatic polyhydric alcohol forming the polyester, for instance, is neopentyl glycol, trimethylolpropane, ditrimethylolpropane, trimethylolethane, ditrimethylolethane, pentaerythritol, dipentaerythritol, and tripentaerythritol. As is not the case with the polyol ester of the first composition according to the invention, however, the fatty acid used should have 8 to 12 carbon atoms. Preferable to this end are pelargonic acid, caprylic acid, undecylic acid, lauric acid and tridecylic acid. Also, partial esters of the aliphatic polyhydric alcohol with the linear or branched fatty acid may be used. These partial esters may be obtained by the reaction of the aliphatic polyhydric alcohol with the fatty acid, while controlling their number of reaction moles.

Such a polyol ester has a kinematic viscosity of 4 to 15 cSt, preferably 5 to 13 cSt, as measured at 100° C., and accounts for 30% by weight to 70% by weight, preferably 35% by weight to 60% by weight of the composition.

The diester may be the same as used for the first composition mentioned above, but should account for 10% by weight to 70% by weight, preferably 15% by weight to 50% by weight of the composition. At less than 10% by weight the composition becomes poor in miscibility with gasoline, while at higher than 70% by weight the composition offers a problem in connection with anti-seizure performance.

The complex ester used may be an ester of an aliphatic polyhydric alcohol with a linear or branched fatty acid having 8 to 12 carbon atoms, and a linear or branched aliphatic or aromatic dibasic acid.

For such an aliphatic polyhydric alcohol, use may be made of trimethylolpropane, trimethylolethane, pentaerythritol, dipentaerythritol, and so on. The monocarboxylic acid component used may be an aliphatic class of carboxylic acid having 8 to 12 carbon atoms, e.g., heptadecylic acid, stearic acid, nonadecanoic acid, arachic acid, behenic acid and lignoceric acid. The dibasic acid used, for instance, may be succinic acid, adipic acid, pimelic acid, suberic acid, azelaic acid, sebacic acid, undecanoic diacid, dodecanoic diacid, tridecanoic diacid, carboxyoctadecanoic acid, carboxymethyloctadecanoic acid and docosanoic diacid. For instance, the aromatic dibasic acid used may be phthalic acid and isophthalic acid; the aromatic tribasic acid may be trimellitic acid; and the aromatic tetrabasic acid may be pyromellitic acid.

For esterification, the polyhydric alcohol is first allowed to react with the aliphatic or aromatic dibasic acid at a predetermined ratio, thereby obtaining a partial ester product. Then, the partial ester product is permitted to react with the fatty acid. It is here noted that the reaction order of the acids may be reversed. It is also understood that a mixture of the acids may be used for esterification.

The complex ester is added to the composition as a viscosity-regulating heavy oil, and has a kinematic viscosity of 10 cSt to 14 cSt, preferably 10.5 cSt to 13 cSt, as measured at 100° C.

As regards the proportion of the complex ester added to the composition, it is desired that the proportion of the complex ester to the polyol ester be determined on the basis of the amount of the oil diluent, i.e., the low-viscosity diester used, whereby the target viscosity is achieved. In other words, there is no need of adding the complex ester to the composition, when the polyol ester itself can impart a high-enough viscosity to the composition; that is, the complex ester may be added to the composition in an amount of 0% by weight to 35% by weight, should the occasion arise.

The dispersant incorporated in the second composition of the invention may be the same as used for the first composition of the invention mentioned above, and may be used at the same ratio as in the first composition. Here, too, the composition may additionally contain rust inhibitors, antifoamants, metal detergents, anti-wear agents, antioxidants, pour point dispersants, and so on, if the occasion arises.

It is understood that the second composition of the invention may be used in the form of a low-oil mixture, e.g., a 100-to-1 gasoline mixture.

In the ensuing description, the components of the third composition of the invention will be explained at great length.

The base oil of the third lubricating oil composition according to the invention may comprise:

(a) 30% by weight to 70% by weight of a polyol ester having a kinematic viscosity of 9 to 15 cSt at 100° C., (b) 30% by weight to 70% by weight of a diester having a kinematic viscosity of 2 to 5 cSt at 100° C., (c) 1% by weight to 5% by weight of a polybutene having a molecular weight of 500 to 2,500 and/or 1% by weight to 5% by weight of a polymethacrylate having a molecular weight of 5,000 to 40,000—used for the preparation of the first composition mentioned above;

(a) 30% by weight to 70% by weight of a polyol ester having a kinematic viscosity of 4 to 15 cSt at 100° C., (b) 0% by weight to 35% by weight of a complex ester having a kinematic viscosity of 10 to 14 cSt at 100° C., and (c) 10% by weight to 70% by weight of a diester having a kinematic viscosity of 2 to 5 cSt at 100° C.—used for the preparation of the second composition mentioned above;

mineral oil;

a poly-α-olefin; and so on.

For the mineral oil, use may be made of 30 neutral oil, 100 neutral oil, 150 neutral oil, 300 neutral oil and 500 neutral oil, all being subjected to solvent or hydrogenation refining, as well as low pour point oils obtained by removal of wax matter from these oils so as to improve their low-temperature fluidity. These oils may be used either alone or in the form of a mixture obtained by mixing them together at a suitable rate.

For the poly-α-olefin, use may be made of a homopolymer of any one member selected from olefinic hydrocarbons that have 2 to 14 carbon atoms and may or may not be branched, or a copolymer of at least two members selected therefrom. The homopolymer and copolymer have a mean molecular weight of 100 to about 2,000, and should preferably be cleared of an unsaturated bond by hydrogenation.

Among these base oils, those comprising (a) 30% by weight to 70% by weight of a polyol ester having a kinematic viscosity of 9 to 15 cSt at 100° C., (b) 30% by weight to 70% by weight of a diester having a kinematic viscosity of 2 to 5 cSt at 100° C., and (c) 1% by weight to 5% by weight of a polybutene having a molecular weight of 500 to 2,500 and/or 1% by weight to 5% by weight of a polymethacrylate having a molecular weight of 5,000 to 40,000 , all constituting the first composition of the invention, is preferable in view of biodegradability, anti-seizure performance and high-temperature detergency.

The third composition according to the invention is characterized by containing as dispersants a polyamide type dispersant in an amount of 5% by weight to 25% by weight, and a neutral calcium sulfonate and a neutral calcium salicylate which amount to 0.1% by weight to 5.0% by weight in all.

The polyamide type dispersant is generally excellent in detergency, but is inferior in heat resistance, e.g., high-temperature detergency, to an imide succinate type dispersant. According to the invention, however, it is found that a composition—that is excellent in detergency at high temperature, can have a low viscosity at low temperature, and is improved in terms of miscibility with gasoline—is achievable by the incorporation therein of the neutral calcium sulfonate and calcium salicylate in the total amount of 0.1% by weight to 5.0% by weight together with the polyamide type dispersant.

The polyamide type dispersant is of the ashless type, and examples thereof are Lubrizol 390, Lubrizol 397 and Lubrizol 398, all the products made by Lubrizol Co., Ltd., and Oronite 340R and Oronite RB, all the products made by Oronite Japan Co., Ltd. The polyamide type dispersant is added to the composition in an amount of 5% by weight to 25% by weight, preferably 10% by weight to 20% by weight.

Examples of the neutral calcium sulfonate used along with the polyamide type dispersant are Lubrizol 65 made by Lubrizol Co., Ltd., PARANOX-24 made by Exon Chemical Co., Ltd., CaPetrona made by Uitoko Chemical Co., Ltd., OLOA 246B made by Karonite Chemical Co., Ltd., and TLA 256 made by Texaco Co., Ltd., and examples of the neutral calcium salicylate are SAP 002 made by Shell Chemical Co., Ltd., and so on. These neutral calcium sulfonate and calcium salicylate are added to the composition in the total amount of 0.1% by weight to 5% by weight, preferably 0.5% by weight to 3.0% by weight. The neutral calcium sulfonate and calcium salicylate may be used at a weight ratio of 8:2 to 2:8. The total amount of the neutral calcium sulfonate and calcium salicylate exceeding 5.0% by weight is not preferable, because they become deposits as such.

Additionally, the third composition of the invention may contain rust inhibitors, anti-foamants, metal detergents, anti-wear agents, antioxidants, pour point dispersants, and so on, if the occasion arises.

As is the case with the first and second compositions, the third composition may be used in the form of a low-oil mixture, e.g., a 100-to-1 gasoline mixture.

The first composition of the invention will now be explained, more specifically but not exclusively, with reference to the following examples.

EXAMPLE 1

Prepared was Sample Oil 1 of the invention with the composition given below.

| | |
|---|---|
| (1) Esterified product of trimethylolpropane (1 mole) with a $C_{18}$ monocarboxylic acid (3 moles), with a viscosity of 13 cSt at 100° C. | 43.5% by weight |
| (2) Esterified product of adipic acid with a $C_8$ monoalcohol, with a viscosity of 2.5 cSt at 100° C. | 39.5% by weight |
| (3) Polybutene with an M.W. of 1,500 and 750 cSt at 100° C. | 2.0% by weight |
| (4) Polyamide type ashless dispersant (Lubrizol 397 made by Lubrizol Co., Ltd.) | 15.0% by weight |

Prepared was Sample Oil 2 of the invention with the composition given below.

| | |
|---|---|
| (1) Esterified product of trimethylolpropane (1 mole) with a $C_{18}$ monocarboxylic acid (3 moles), with a viscosity of 13 cSt at 100° C. | 43.5% by weight |
| (2) Esterified product of adipic acid with a $C_8$ monoalcohol, with a viscosity of 2.5 cSt at 100° C. | 39.5% by weight |
| (3) Polybutene with an M.W. of 800 and 120 cSt at 100° C. | 2.0% by weight |
| (4) Polyamide type ashless dispersant (Lubrizol 397 made by Lubrizol Co., Ltd.) | 15.0% by weight |

Prepared was Sample Oil 3 of the invention with the composition given below.

| | |
|---|---|
| (1) Esterified product of trimethylolpropane (1 mole) with a $C_{18}$ monocarboxylic acid (3 moles), with a viscosity of 13 cSt at 100° C. | 34.0% by weight |
| (2) Esterified product of adipic acid with a $C_8$ monoalcohol with a viscosity of 2.5 cSt at 100° C. | 49.0% by weight |
| (3) Polymethyl methacrylate with an M.W. of 20,000 | 2.0% by weight |
| (4) Polyamide type ashless dispersant (Lubrizol 397 made by Lubrizol Co., Ltd.) | 15.0% by weight |

Prepared was Sample Oil 4 of the invention with the composition given below.

| | |
|---|---|
| (1) Esterified product of trimethylolpropane (1 mole) with a $C_{18}$ monocarboxylic acid (3 moles), with a viscosity of 13 cSt at 100° C. | 34.0% by weight |
| (2) Esterified product of adipic acid with a $C_8$ monoalcohol with a viscosity of 2.5 cSt at 100° C. | 49.0% by weight |
| (3) Polymethyl methacrylate with an M.W. of 10,000 | 2.0% by weight |
| (4) Polyamide type ashless dispersant (Lubrizol 397 made by Lubrizol Co., Ltd.) | 15.0% by weight |

Sample Oils 1–4 were tested together with Comparative Oils 1–3 (with the compositions given below) in terms of (1) biodegradability, (2) anti-seizure performance, (3) detergency, and (4) miscibility with gasoline and low-temperature fluidity.

| | |
|---|---|
| **Comparative Oil 1** | |
| (1) Mineral oil 1 with a viscosity of 13 cSt at 100° C. | 58.0% by weight |
| (2) Mineral oil 2 with a viscosity of 31 cSt at 100° C. | 8.0% by weight |
| (3) Kerosene having a boiling point of 155° C. to 270° C. | 19.0% by weight |
| (4) Polyamide type dispersant | 15.0% by weight |
| **Comparative Oil 2** | |
| (1) Polybutene 1 with a viscosity of 90 cSt at 100° C. | 5.0% by weight |
| (2) Polybutene 2 with a viscosity of 240 cSt at 100° C. | 15.0% by weight |
| (3) Kerosene having a boiling point of 155° C. to 270° C. | 20.0% by weight |
| (4) Mineral oil with a viscosity of 13 cSt at 100° C. | 55.0% by weight |
| (5) Ca sulfonate | 1.0% by weight |
| (6) Imide succinate | 4.0% by weight |
| **Comparative Oil 3** | |
| (1) Esterified product of trimethylolpropane (1 mole) with a $C_{18}$ monocarboxylic acid (3 moles), with a viscosity of 15 cSt at 100° C. | 72.0% by weight |
| (2) Kerosene having a boiling point of 155° C. to 270° C. | 18.0% by weight |
| (3) Polyamide type ashless dispersant - Lubrizol 397 made by Lubrizol Co., Ltd. | 10.0% by weight |

(A) Biodegradability

According to the amended MITI method, a basic culture solution (300 cc) and cultured cells (obtained by acclimatizing waste water discharged from a municipal sewage disposal plant with artificial sewage) were added to each of the sample and comparative oils (30 mg), followed by a 28-day stirring at 25° C. Then, the biodegradability of each oil was estimated by the ratio of the amount of oxygen consumed by the microorganisms so as to decompose the oil to the theoretical oxygen amount. The results of the sample oils according to the invention are set out in Table 1, and the results of the comparative oils are shown in Table 2.

(B) Anti-Seizing Property

Under the following conditions, each of the sample and comparative oils was tested in combination with an engine, while the temperature of the ignition plug was increased at an increment of 5° C. from the test start temperature of 245° C. The anti-seizure performance of the oil was estimated by the plug temperature at which the engine seized up. Again, the results are shown in Tables 1 and 2.

Engine under test: Robin engine EC-10D made by Fuji Heavy Industries, Ltd.

Fuel/Oil:100:1

Test Cycle:Four cycles, each comprising a five-minute full load and a one-minute non-load

TABLE 1

| Sample Oil | 1 | 2 | 3 | 4 |
|---|---|---|---|---|
| Biodegradability, % | 68 | 68 | 68 | 67 |
| Seizing-Up Plug Temperature, °C. | 270 | 275 | 275 | 270 |

TABLE 2

| Comparative Oil | 1 | 2 | 3 |
|---|---|---|---|
| Biodegradability, % | 20 | 20 | 55 |
| Seizing-Up Plug Temperature, °C. | 265 | 260 | 270 |

From Tables 1 and 2, it is found that the sample oils of the invention provide lubricating oil compositions that are higher than the comparative oils in terms of biodegradability and seizing-up plug seat temperature.

(C) Detergency

A Robin engine EC-10D made by Fuji Heavy Industries, Ltd. was driven at a full load of 5000 rpm for 4 hours. Then, the detergency was estimated by what states the rings and pistons were in (with a plug seat temperature of 215° to 218° C. and a fuel to oil ratio of 100 to 1).

TABLE 3

| Sample Oil | 1 | 2 | 3 | 4 |
|---|---|---|---|---|
| Top ring state | 0.8 | 0.8 | 0.7 | 0.7 |
| Top land | 0.96 | 0.97 | 0.95 | 0.95 |
| Top ring group | 0.93 | 0.93 | 0.93 | 0.93 |
| Second land | 0.99 | 1.00 | 0.98 | 0.98 |
| Second ring group | 0.99 | 1.00 | 0.99 | 0.99 |
| Piston skirt | 0.99 | 1.00 | 0.99 | 0.99 |
| Under crown | 0.95 | 0.99 | 0.90 | 0.89 |
| Total* | 6.61 | 6.69 | 6.44 | 6.43 |

*on the basis of 7 points

TABLE 4

| Comparative Oil | 1 | 3 |
|---|---|---|
| Top ring state | 0.5 | 0.3 |
| Top land | 0.91 | 0.86 |
| Top ring group | 0.88 | 0.89 |
| Second land | 0.98 | 0.96 |

TABLE 4-continued

| Comparative Oil | 1 | 3 |
|---|---|---|
| Second ring group | 0.99 | 0.97 |
| Piston skirt | 0.99 | 0.99 |
| Under crown | 0.85 | 0.78 |
| Total* | 6.10 | 5.75 |

*on the basis of 7 points

The sample oils according to the invention are superior to the comparative oils in terms of the rings and pistons.

(C) Miscibility with Gasoline, and Low-Temperature Fluidity

The miscibility-with-gasoline and low-temperature fluidity of each oil were evaluated according to ASTM D4682. The results are set out in Table 5.

TABLE 5

| | SO1 | SO2 | SO3 | SO4 | CO1 |
|---|---|---|---|---|---|
| Miscibility with gasoline, rpm | 26 | 26 | 26 | 26 | 26 |
| Pour point, °C. | −37.5 | −37.5 | −37.5 | −37.5 | −37.5 |

SO: sample oil, and CO: comparative oil

It is found that the sample oils according to the invention are equivalent to the conventional oil product in terms of miscibility with gasoline and pour point.

In the following description, the second composition of the invention will be explained, more specifically but not exclusively, with reference to the following examples.

EXAMPLE 2

Prepared was Sample Oil 5 according to the invention with the composition given below.

| | |
|---|---|
| (1) Esterified product of pentaerythritol (1 mole) with a mixture (4 moles) of $C_8$, $C_9$ and $C_{10}$ monocarboxylic acids at 37:63.8:0.2 by weight, with a viscosity of 6 cSt at 100° C. | 49% by weight |
| (2) Esterified product of adipic acid with a $C_8$ monoalcohol, with a viscosity of 3 cSt at 100° C. | 15% by weight |
| (3) Esterified product of pentaerythritol (1 mole) with a mixture (4 moles, calculated as carboxyl groups) of $C_8$, $C_{10}$and $C_{12}$ monocarboxylic acids with adipic acid at 70:26:2:2 by weight, with a viscosity of 11.5 cSt at 100° C. | 26% by weight |
| (4) Polyamide type ashless dispersant, Lubrizol 397 made by Lubrizol Co., Ltd. | 10% by weight |

Used in this example were comparative oils with the compositions given below.

| Comparative Oil 4 | |
|---|---|
| (1) Mineral oil 1 with a viscosity of 13 cSt at 100° C. | 58% by weight |
| (2) Mineral oil 2 with a viscosity of 31 cSt at 100° C. | 8% by weight |
| (3) Kerosene having a boiling point of 155° C. to 270° C. | 19% by weight |
| (4) Polyamide type of ashless dispersant, Lubrizol 397 made by Lubrizol Co., Ltd. | 15% by weight |

-continued

| Comparative Oil 5 | |
|---|---|
| (1) Esterified product of pentaerythritol (1 mole) with a $C_{18}$ monocarboxylic acid (4 moles), with a viscosity of 13 cSt at 100° C. | 72% by weight |
| (2) Kerosene having a boiling point of 155° C. to 270° C. | 18% by weight |
| (3) Polyamide type of ashless dispersant, Lubrizol 397 made by Lubrizol Co., Ltd. | 10% by weight |

Each of Sample Oil 5 and Comparative Oils 4 and 5 was tested for biodegradability in the following manner.

According to the amended MITI method, a basic culture solution (300 cc) and cultured cells (obtained by acclimatizing waste water discharged from a municipal sewage disposal plant with artificial sewage) were added to each of the sample and comparative oils (30 mg), followed by a 28-day stirring at 25° C. Then, the biodegradability of each oil was estimated by the ratio of the amount of oxygen consumed by the microorganisms so as to decompose the oil to the theoretical oxygen amount. The results are set out in Table 6.

TABLE 6

| | Sample Oil 5 | Comp. Oil 4 | Comp. Oil 5 |
|---|---|---|---|
| Biodegradability, % | 68 | 20 | 55 |

Table 5 indicates that the sample oil according to the invention provides a lubricating oil composition that is superior to the comparative oils in terms of biodegradability.

In the ensuing description, the third composition of the invention will be explained, more specifically but not exclusively, with reference to the following examples.

EXAMPLE 3

Prepared was Sample Oil 6 of the invention with the composition mentioned below.

| | |
|---|---|
| (1) Esterified product of trimethylolpropane (1 mole) with a $C_{18}$ monocarboxylic acid (3 moles), with a viscosity of 13 cSt at 100° C. | 42.2% by weight |
| (2) Esterified product of adipic acid with a $C_8$ monoalcohol, with a viscosity of 2.5 cSt at 100° C. | 38.5% by weight |
| (3) Polybutene with a molecular weight of 1,500 and a viscosity of 750 cSt at 100° C. | 1.8% by weight |
| (4) Polyamide type ashless dispersant, Lubrizol 397 made by Lubrizol Co., Ltd. | 15.0% by weight |
| (5) Neutral calcium sulfonate, Ca-Petrona made by Uitoko Chemical Co., Ltd. | 1.5% by weight |
| (6) Neutral calcium salicylate, SAP 002 made by Shell Chemical Co., Ltd. | 1.0% by weight |

EXAMPLE 4

Prepared was Sample Oil 7 according to the invention, with the composition mentioned below.

| | |
|---|---|
| (1) Esterified product of trimethylolpropane (1 mole) with a $C_{18}$ monocarboxylic acid (3 moles), with a viscosity of 13 cSt at 100° C. | 42.0% by weight |
| (2) Esterified product of adipic acid with a $C_8$ monoalcohol, with a viscosity of 2.5 cSt at 100° C. | 38.3% by weight |
| (3) Polybutene with a molecular weight of 800 and a viscosity of 120 cSt at 100° C. | 1.8% by weight |
| (4) Polyamide type of ashless dispersant, Lubrizol 397 made by Lubrizol Co., Ltd. | 15.0% by weight |
| (5) Neutral calcium sulfonate, TLA 256 made by Texaco Co., Ltd. | 1.9% by weight |
| (6) Neutral calcium salicylate, SAP 002 made by Shell Chemical Co., Ltd. | 1.0% by weight |

EXAMPLE 5

Prepared was Sample Oil 8 according to the invention, with the composition mentioned below.

| | |
|---|---|
| (1) Esterified product of trimethylolpropane (1 mole) with a $C_{18}$ monocarboxylic acid (3 moles), with a viscosity of 13 cSt at 100° C. | 32.5% by weight |
| (2) Esterified product of adipic acid with a $C_8$ monoalcohol, with a viscosity of 2.5 cSt at 100° C. | 46.9% by weight |
| (3) Polymethyl methacrylate with a molecular weight of 20,000 | 1.8% by weight |
| (4) Polyamide type of ashless dispersant, Lubrizol 397 made by Lubrizol Co., Ltd. | 15.0% by weight |
| (5) Neutral calcium sulfonate, Lubrizol 65 made by Lubrizol Co., Ltd. | 2.8% by weight |
| (6) Neutral calcium salicylate, SAP 002 made by Shell Chemical Co., Ltd. | 1.0% by weight |

EXAMPLE 6

Prepared was Sample Oil 9 according to the invention, with the composition mentioned below.

| | |
|---|---|
| (1) Esterified product of trimethylolpropane (1 mole) with a $C_{18}$ monocarboxylic acid (3 moles), with a viscosity of 13 cSt at 100° C. | 33.0% by weight |
| (2) Esterified product of adipic acid with a $C_8$ monoalcohol, with a viscosity of 2.5 cSt at 100° C. | 47.5% by weight |
| (3) Polymethyl methacrylate with a molecular weight of 10,000 | 1.8% by weight |
| (4) Polyamide type of ashless dispersant, Lubrizol 397 made by Lubrizol Co., Ltd. | 15.0% by weight |
| (5) Neutral calcium sulfonate, PARANOX 24 made by Exon Chemical Co., Ltd. | 1.7% by weight |
| (6) Neutral calcium salicylate, SAP 002 made by Shell Chemical Co., Ltd. | 1.0% by weight |

Each of the thus obtained lubricating oil compositions was measured in terms of (1) high-temperature detergency, and (2) low-temperature viscosity.

In the following description, the compositions of the reference oils used for the purpose of comparison are mentioned.

| Reference Oil 1 | |
|---|---|
| (1) Esterified product of trimethylolpropane (1 mole) with a $C_{18}$ monocarboxylic acid (3 moles), with a viscosity of 13 | 39.6% by weight |

-continued

| | |
|---|---|
| cSt at 100° C. | |
| (2) Esterified product of adipic acid with a $C_8$ monoalcohol, with a viscosity of 2.5 cSt at 100° C. | 36.2% by weight |
| (3) Polybutene with a molecular weight of 1,500 and a viscosity of 750 cSt at 100° C. | 1.7% by weight |
| (4) Imide succinate | 20.0% by weight |
| (5) Neutral calcium sulfonate, Ca-Petrona made by Uitoko Chemical Co., Ltd. | 1.5% by weight |
| (6) Neutral calcium salicylate, SAP 002 made by Shell Chemical Co., Ltd. | 1.0% by weight |
| Reference Oil 2 | |
| (1) Esterified product of trimethylolpropane (1 mole) with a $C_{18}$ monocarboxylic acid (3 moles), with a viscosity of 13 cSt at 100° C. | 40.9% by weight |
| (2) Esterified product of adipic acid with a $C_8$ monoalcohol, with a viscosity of 2.5 cSt at 100° C. | 37.3% by weight |
| (3) Polybutene with a molecular weight of 1,500 and a viscosity of 750 cSt at 100° C. | 1.8% by weight |
| (4) Imide succinate | 20.0% by weight |

How to measure high-temperature detergency and low-temperature viscosity will now be described. The high-temperature detergency was evaluated, using a hot tube test (HTT) made by Komatsu Ltd. According to HTT, each of the sample and comparative oils was passed through a glass tube of 2 mm in inner diameter and 300 mm in length at an air flow rate of 10±0.5 cc/min, an oil flow rate of 0.3±0.01 cc/h and a temperature of 280°±1° C. for 16 hours. Then, the glass tube was washed with hexane and fully dried to estimate the degree of contamination of the glass tube on the basis of 10 HTT color points. The higher the point, the higher detergency the oil has. The low-temperature viscosity of the oil was estimated by the Brookfield viscosity (cP) measured at −10° C. according to TCW II provided on outboard motors. The lower the value, the better the low-temperature viscosity is.

Also, these oils were measured for biodegradability and anti-seizure performance, as in Example 1.

The results of these properties of the sample and reference oils measured are set out in Tables 7 and 8.

TABLE 7

| | High-Temp. Detergency (color points) | Low-Temp. Viscosity, cP |
|---|---|---|
| SO 6 | 9 | 880 |
| SO 7 | 10 | 860 |
| SO 8 | 10 | 880 |
| SO 9 | 9 | 850 |
| RO 1 | 9 | 1320 |
| RO 2 | 4 | 760 |

TABLE 8

| | Biodegradability, % | Seizing-Up Plug Temperature, °C. |
|---|---|---|
| SO 6 | 68 | 270 |
| SO 7 | 68 | 275 |
| SO 8 | 68 | 275 |
| SO 9 | 67 | 270 |
| RO 1 | 65 | 275 |
| RO 2 | 67 | 270 |

SO: sample oil, and RO: reference oil

Tables 7 and 8 teach that the two-cycle engine oils according to the third aspect of the invention are excellent in biodegradability, anti-seizure performance and high-temperature detergency, and are reduced in low-temperature viscosity as well.

What we claim:

1. A biodegradable lubricating oil composition for a two-cycle engine miscible with gasoline consisting essentially of:

30% to 70% by weight of a polyol ester having a kinetic viscosity of 9 to 15 cSt at 100° C., said polyol ester being an esterification product of a straight-chain or branched fatty acid having 16 to 24 carbon atoms and an aliphatic polyhydric alcohol;

30% to 70% by weight of a diester having a kinetic viscosity of 2 to 5 cSt at 100° C., said diester being an esterification product of a straight-chain or branched aliphatic dibasic acid having 6 to 10 carbon atoms and an aliphatic alcohol having 6 to 10 carbon atoms;

1% to 5% by weight of a polybutene having a molecular weight of 500 to 2,500 or of a polymethacrylate having a molecular weight of 5,000 to 40,000; and 5% to 25% by weight of a dispersant.

2. A lubricating oil composition for a two-cycle engine according to claim 1, wherein the dispersant is a polymide.

3. A biodegradable lubricating oil composition for a two-cycle engine miscible with gasoline consisting essentially of:

30% to 70% by weight of a polyol ester having a kinetic viscosity of 9 to 15 cSt at 100° C., said polyol ester being an esterification product of a straight-chain or branched fatty acid having 16 to 24 carbon atoms and an aliphatic polyhydric alcohol;

30% to 70% by weight of a diester having a kinetic viscosity of 2 to 5 cSt at 100° C., said diester being an esterification product of a straight-chain or branched aliphatic dibasic acid having 6 to 10 carbon atoms and an aliphatic alcohol having 6 to 10 carbon atoms;

1% to 5% by weight of a polybutene having a molecular weight of 500 to 2,500 or of a polymethacrylate having a molecular weight of 5,000 to 40,000;

5% to 25% by weight of a polyamide type dispersant; and 0.1% to 5% by weight of at least one of a neutral calcium sulfonate and a neutral calcium salicylate.

* * * * *